United States Patent [19]

Versluis et al.

[11] 4,449,946

[45] May 22, 1984

[54] SINGLE-POINT MOORING SYSTEM FOR TRANSFERRING FLUIDS

[75] Inventors: Jan Versluis; Johan deGroot; Anton van Baalen, all of The Hague, Netherlands

[73] Assignee: Shell Oil Company, Houston, Tex.

[21] Appl. No.: 436,226

[22] Filed: Oct. 25, 1982

[30] Foreign Application Priority Data

Nov. 16, 1981 [NL] Netherlands ..... 8105167

[51] Int. Cl.[3] ..... B63B 21/52

[52] U.S. Cl. ..... 441/4; 114/230

[58] Field of Search ..... 114/230, 219, 220; 441/3, 4, 5; 141/387, 388

[56] References Cited

U.S. PATENT DOCUMENTS 3,191,201 6/1965 Richardson et al. ..... 441/3

3,365,734 1/1968 Petrie et al. ..... 441/5

4,000,532 1/1977 Nielsen ..... 114/219

4,107,803 8/1978 Sylverst ..... 441/4

*Primary Examiner*—Trygve M. Blix

*Assistant Examiner*—Jesûs D. Sotelo

[57] ABSTRACT

The single buoy mooring system comprises a central element adapted to be anchored by means of anchor cables and a buoyant outer element rotatably arranged around the central element. The outer element comprises an open beam structure connected to a large diameter outer ring. Foam-filled fenders are secured to the large diameter outer ring. Preferably the fenders act as floats. An important advantage of this arrangement is that, when a ship moored to the system hits the system, the risk of damage to the ship or the system is substantially reduced as compared to the conventional single buoy mooring systems.

2 Claims, 3 Drawing Figures

SINGLE-POINT MOORING SYSTEM FOR TRANSFERRING FLUIDS

BACKGROUND OF THE INVENTION

The invention relates to a single-point mooring system for transferring fluids, comprising a central element provided with connecting means for anchor cables and a rotatable line coupling and a rotatable element rotatably connected to the central element, the rotatable element being provided with a substantially annular buoyancy unit, with means for mooring a ship and with a fluid line connected to the rotatable line coupling. Such single-point mooring systems are known and are especially used for the offshore loading and unloading of tankers for the transport of crude oil and oil products, the ship being moored at her bow to the mooring system by means of a mooring line and the ship's tanks being connected to the fluid line of the mooring system by means of a floating fluid hose.

A problem that arises in the known single-point mooring system is that if a ship collides with the single-point mooring system, for example owing to a combination of waves, current and wind, the risk of damage ot the ship, the single-point mooring system or to the anchorage thereof can be considerable.

SUMMARY OF THE INVENTION

It is an object of the invention to provide a single-point mooring system having the advantage that the risk of damage to the ship, the single-point mooring system and the anchorage of the single-point mooring system will be limited in the event of a collision between the ship and the single-point mooring system.

It is another object of the invention to provide a single-point mooring system that offers a high degree of reliability and safety, even under adverse weather conditions.

The invention further aims at providing a single-point mooring system with which in the event of extremely high waves minimum fluctuations of the tensile forces in the anchor cables occur, so that the risk of breakage of the anchor cables and of the anchors breaking loose from the water bottom and the risk of damage to the single-point mooring system by the anchor cables are limited.

A further object of the invention is to provide a single-point mooring system with which in the event of high waves minimum fluctuation occurs of the tensile force in the mooring line between a moored ship and the single-point mooring system.

To this end the single-point mooring system according to the invention is characterized in that the distance between any point on the outer circumference of the buoyancy unit and the axis of rotation is large in relation to the distance between any anchor cable connecting means and the axis of rotation, as compared to the structures disclosed in U.S. Pat. Nos. 3,178,737, 3,735,435 and 4,067,080.

In an attractive embodiment of the single-point mooring system according to the invention the central element is positioned in such a manner that the central element is entirely above the water surface during normal operation.

In a suitable embodiment of the single-point mooring system according to the invention the buoyancy unit comprises a series of flexible floats.

An advantage of the anchor cable connecting means being located relatively close to the axis of rotation is that the variation of the tensile forces in the anchor cables, when the single-point mooring system is rolling in a swell, is substantially reduced. Moreover, the forces acting in the single-point mooring system can be further reduced by choosing a suitable relationship between the rolling stability of the single-point mooring system and the height of the point at which the forces of the mooring lines of a moored vessel act on the single-point mooring system. The single-point mooring system then acts as a resilient link between the mooring lines of the ship and the anchor cables.

Advantages of positioning the central element above the water surface are that assembly, disassembly, repairs and inspection of the anchor cable connecting means and of the bearing connecting the central element to the rotating element can be carried out without divers' assistance.

BRIEF DESCRIPTION OF THE DRAWING

The invention will be further illustrated below with reference to the Figures, in which.

DESCRIPTION OF A PREFERRED EMBODIMENT

Figure 1:
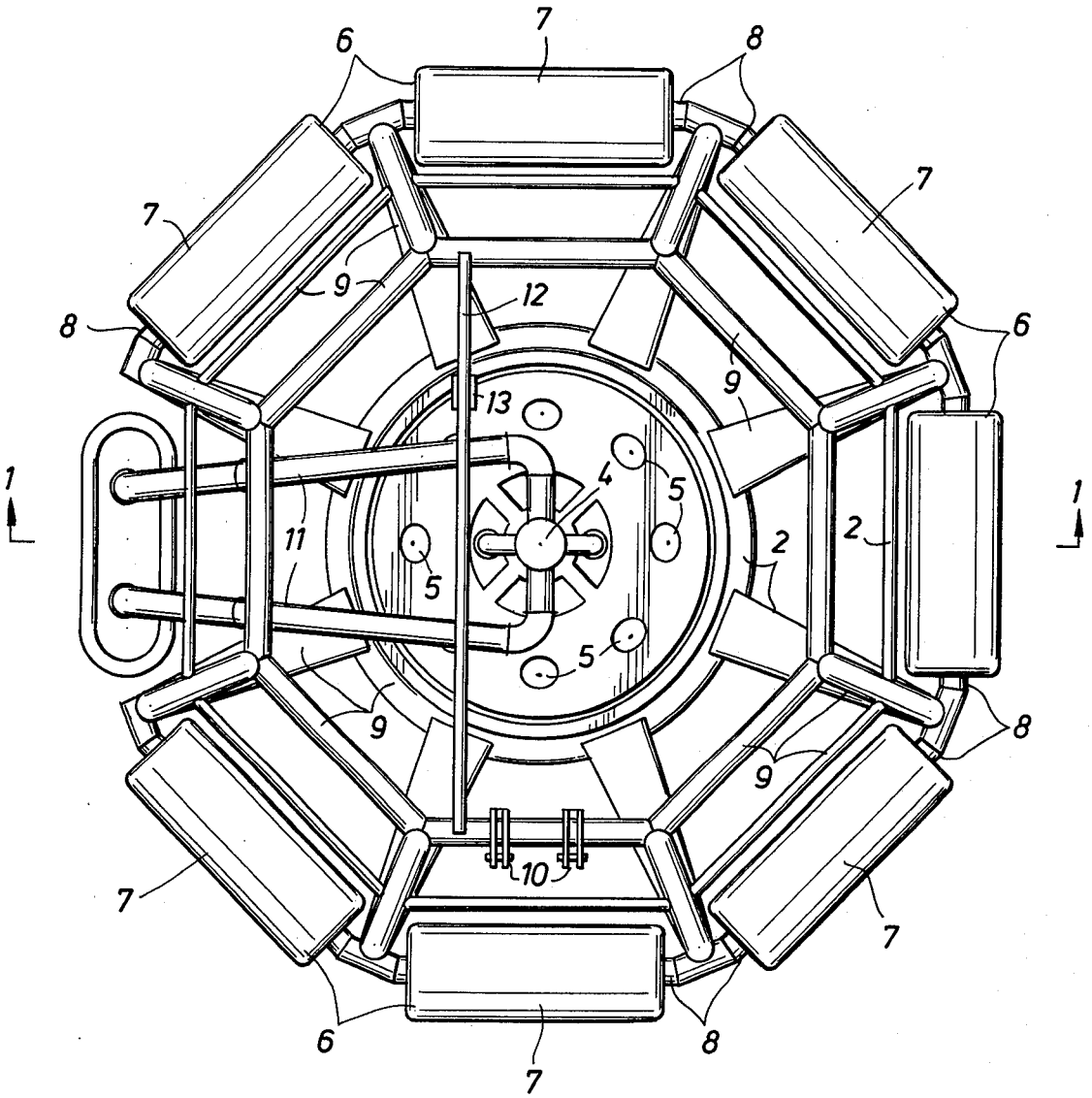
FIG. 1 shows a plan view of an embodiment of the single-point mooring system according to the invention.
Figure 2:
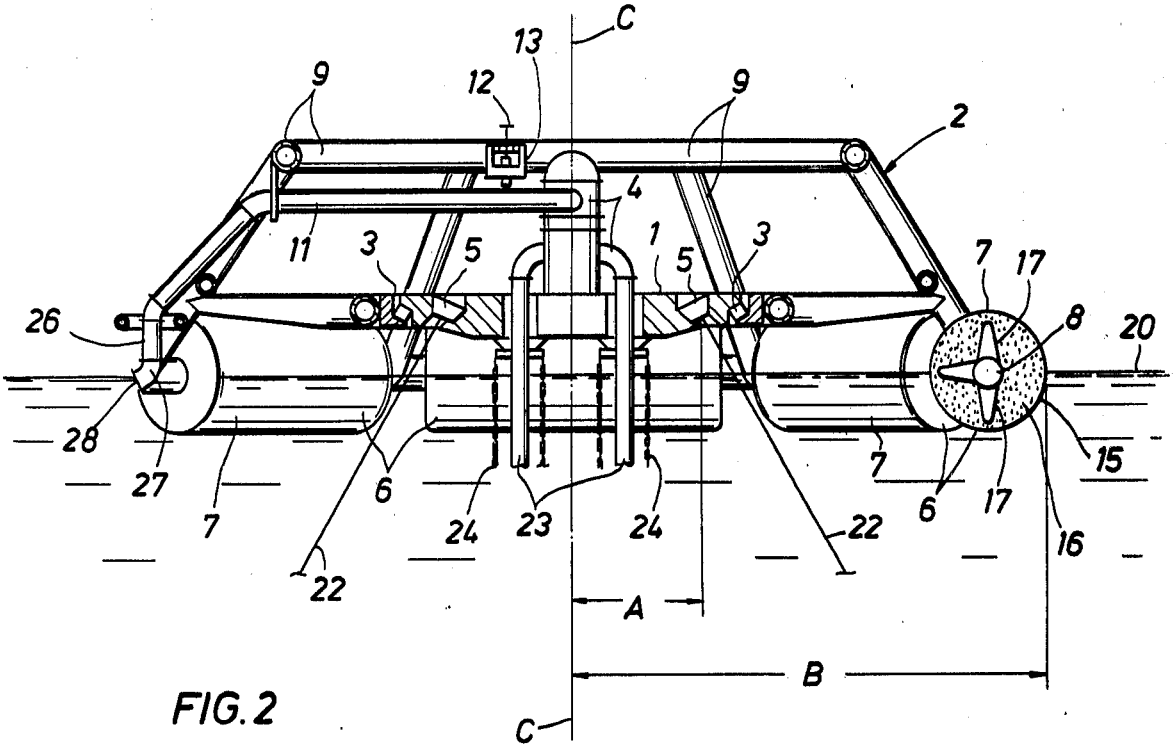
FIG. 2 shows a section along the line 1—1 of the single-point mooring system of FIG. 1.

The central element of the single-point mooring system shown in the FIGS. 1 and 2 is indicated with the reference numeral 1. The central element 1 is rotatably connected to a rotatable element 2 by means of a bearing 3 which can absorb both axial and radial forces.

The central element 1 is provided with a rotatable line coupling 4 and with connecting means 5 for anchor cables 22.

The rotatable element 2 is provided with a substantially annular buoyancy unit 6 comprising a series of flexible floats 7 that are located at the circumference of the single-point mooring system, so that the flexible floats 7 have a shock-absorbing effect in the event of collisions with a moored ship (not shown), which reduces the risk of damage to the single-point mooring system and the ship. Each flexible float 7 is secured around a rigid reinforcing member 8. A supporting frame 9 is at one side secured to the reinforcing members 8 and at the other side to the bearing 3, in such a manner that the buoyancy unit 6 supports the central element 1 via the supporting frame 9 and the bearing 3. The rotatable element 2 is provided with means 10 for mooring a ship (not shown), and with fluid lines 11, such as oil loading or unloading lines, connected to the rotatable line coupling 4. To the supporting frame 9 a hoisting beam 12 is secured from which a movable hoist 13 is suspended for performing hoisting jobs, such as securing and tensioning the anchor cables 22, part of the hoisting beam 12 being located over the central element 1.

FIG. 2 shows a cross-section of the single-point mooring system of FIG. 1, in which the single-point mooring system is floating at the surface 20 of a body of water 21. The single-point mooring system is connected to anchors in the bottom (not shown) of the body of water 21 by means of anchor cables 32. The anchor cables 22 are secured to the central element 1 of the single-point mooring system by the anchor cable connecting means 5. The smallest distance B between the outer circumference of the buoyancy unit 6 and the axis of rotation C in the embodiment shown is more than thrice as large as the distance A between the connecting means 5 for the anchor cables 22 and the axis of rotation C. Each flexible float 7 consists of an impact-resistant flexible plastic sheath 15 surrounding a low-density foam material 16 that is secured around a rigid reinforcing member 8. Each reinforcing member 8 is provided with ribs 17 reinforcing the float 7 and increasing the impact resistance of the float 7. The central element 1 is supported via the bearing 3 by the supporting frame 9 of the rotatable element 2 in such a manner that the central element 1 is entirely above the water surface 20 during normal operation.

The rotatable line coupling 4 is at one end connected to flexible fluid lines 23 extending towards the water bottom (not shown) and connected to an underwater pipeline (not shown), the flexible fluid lines 23 being protected from damage or high tensile forces by chains 24 fitted next to the flexible fluid lines 23. The rotatable line coupling 4 is at the other end connected to the fluid lines 11 suspended from the supporting frame 9. The fluid lines 11 are connected to swivelling bends 27 by means of rotatable couplings 26, the end flanges 28 of the bends 27 being suitable to be connected to fluid hoses (not shown) floating on the water surface 20, which hoses can be connected to the tanks of a ship (not shown) moored to the single-point mooring system.

Figure 3:
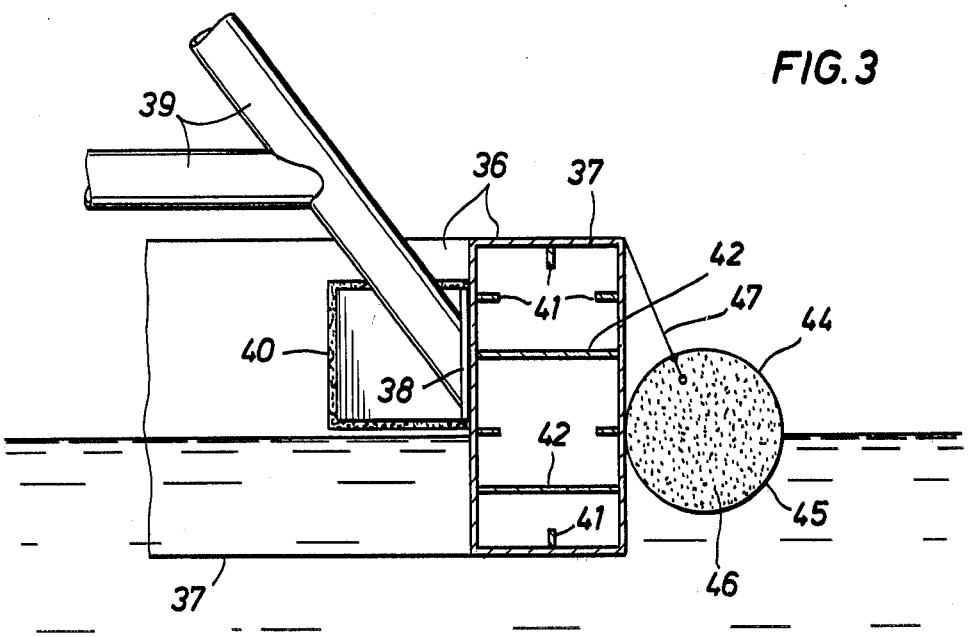
FIG. 3 shows a section of a detail of another embodiment of the single-point mooring system according to the invention.

FIG. 3 shows a cross-section of a detail of another embodiment of the single-point mooring system according to the invention, in which a substantially annular buoyancy unit 36 comprises a series of hollow steel floats 37. The floats 37 are connected to feet 38 of a supporting frame 39 by means of welded connections 40. The floats 37 are on the inside provided with reinforcing ribs 41 and reinforcing plates 42. The buoyancy unit 36 is on its outer circumference provided with a series of flexible shock-absorbing elements 44 that in the event of collisions with a moored ship (not shown) reduce the risk of damage to the single-point mooring system and the ship. Each flexible shock-absorbent element 44 consists of an impact-resistant flexible plastic sheath 45 surrounding a foam material 46. The flexible shock-absorbing elements 44 are connected to the floats 37 by means of connecting lines 47.

We claim as our invention:

1. A single-point mooring system for transferring fluids, comprising a central element, connecting means carried by said central element for operatively securing anchor cables thereto, a rotatable line coupling and a rotatable element rotatably connected to the central element, the rotatable element being provided with a substantially annular buoyancy unit, with means for mooring a ship and with a fluid line connected to the rotatable line coupling, characterized in that the distance between any point on the outer circumference of the buoyancy unit and the axis of rotation is at least twice as large as the distance between each anchor cable connecting means and the axis of rotation, and being further characterized in that the central element is connected to the rotatable element by means of a bearing capable of absorbing both axial and radial forces, said bearing being fitted in such a manner that the bearing is entirely above the water surface during normal operation, with said rotatable element comprising a supporting frame that is on one side connected to the buoyancy unit and on the other side to the bearing.

2. The single-point mooring system as claimed in claim 1, including a hoisting beam secured to the supporting frame, from which beam a hoist is suspended at least part of the hoisting beam being located over the central element.

* * * * *